US005647090A

United States Patent [19]

Yang

[11] Patent Number: 5,647,090

[45] Date of Patent: Jul. 15, 1997

[54] CLEANING APPARATUS WITH SPRAY AND SUCTION CAPABILITY

[76] Inventor: Sung Hwa Yang, 49-12 Shingal-Li Chunwon-Chutaek #20, Kiheung-Eup, Yongin-Kun, Kyungki-Do, Rep. of Korea

[21] Appl. No.: 312,105

[22] Filed: Sep. 26, 1994

[51] Int. Cl.[6] ..... A47K 7/00

[52] U.S. Cl. ..... 15/322; 15/321; 4/443

[58] Field of Search ..... 15/321, 322; 4/420.2, 4/420.4, 443

[56] References Cited

U.S. PATENT DOCUMENTS

| | | | |
|---|---|---|---|
| 3,574,239 | 4/1971 | Sollerud | 15/321 X |
| 3,783,473 | 1/1974 | Engquist | 15/322 |
| 3,866,264 | 2/1975 | Engquist | 15/322 X |
| 4,083,077 | 4/1978 | Knight et al. | 15/322 X |
| 5,361,427 | 11/1994 | Wilk | 4/420.3 |

*Primary Examiner*—Chris K. Moore
*Attorney, Agent, or Firm*—Steven Horowitz

[57] ABSTRACT

A comprehensive diverse nonleaking cleaning apparatus consists of a cleaning portion that sprays water and cleaning fluid while receiving waste products of the sprayed fluid, a waste discharge device that temporarily stores and discharges waste collected from the cleaning portion, and a high pressure hose for spraying fluid therein attached to the cleaning portion and to a blow out motor pump. The apparatus sprays a mixture of water and cleaning fluid and simultaneously retrieves and temporarily stores the waste (including the original sprayed content) by means of an added pressure hose connected to a motor pump. The lavatory embodiment, usable by individuals with limited movement, such as elderly, disabled, bedridden patients etc., has a toilet seat portion for a human to sit on and discharge waste into that receives water and cleaning fluid sprayed from a hose of the cleaning portion onto the human to clean the human, and circulates under the toilet seat to cleans the human's buttocks and anus, break the bodily waste and transmit it to the waste intake path connecting to the waste discharge device. Other embodiments, in which the cleaning portion is formed of two tubes, one within the other, are suitable for cleaning walls, ceilings, floors in factories or roads as well as for cleaning the bottom of rivers and reservoirs. The nonleakage feature increases the diversity and efficiency, lowers the cost of cleaning everywhere and has environmental advantages.

3 Claims, 7 Drawing Sheets

CLEANING APPARATUS WITH SPRAY AND SUCTION CAPABILITY

BACKGROUND OF THE INVENTION

This invention relates to cleaning (including washing, cleaning, rinsing and removal) both physical objects and the human body as well as disposal of their biological waste. While performing various cleaning functions, the invention makes possible the simultaneous spraying of water or water cleaning agent and intake of waste material, including the by-product of sprayed cleaning agent. The device of the present invention can also discharge the waste products that it has collected at will. These functions prevent waste product from leaking or dripping so that walls, ceilings and even the human body can be cleaned. The device's spray and suction method of cleaning is effective at cleaning physical objects and is particularly effective at cleaning the human body and body waste of any individual whose free movement is restricted, such as the elderly and the physically disabled.

DESCRIPTION OF THE PRIOR ART

There are presently cleaning apparatuses of various shapes having a variety of different capabilities. As illustrated in FIGS. 1–3, these and other known cleaning devices can be classified into three categories. Using the term "intake" or "in-take" to mean the taking in or ingestion of something, in this case by a device, FIG. 1 illustrates a device with vacuum cleaning capability which is capable only of dust or dirt intake. FIG. 2 illustrates a device with brush cleaning capability which is capable only of brushing dust, spraying water and wiping by mop. FIG. 3 depicts a device with jet spray cleaning capability that can only perform spraying of water or of a mixture of water and cleaning detergent.

In order to properly and completely perform a cleaning function, a device must perform all of the following functions: it must first eliminate dirt and other waste, it must then spray a mixture of water and cleaning liquid, it must then brush, it must then retrieve the original waste and the waste created by the spraying of the mixture and finally it must discharge the retrieved waste product elsewhere. The main problem with the existing prior art cleaning devices is that they perform only a portion of the range of cleaning functions needed to comprehensively perform cleaning operations.

For example, the vacuum cleaner device depicted in FIG. 1 cannot clean waste product stuck to a floor. Similarly, the brush cleaner depicted in FIG. 2 causes air pollution by blowing dust while it cleans by brushing. In addition, this device also causes a considerable mess from water leakage and dripping while cleaning walls and ceilings. As a result, it is inefficient with respect to human resources since it is necessary during its use to move furniture and fixtures near the area being cleaned to a separate location and then move them back. Furthermore, cleaning near furniture or mixtures that cannot be moved becomes impossible and could involve danger when dirt, dust or other leakage of waste material is caused while cleaning.

Whenever cleaning of objects used in or near an industrial production line is necessary, moreover, efficiency is particularly critical since a specific time is scheduled to stop the production line or to make special arrangements in terms of labor and time. Consequently, the prior art devices result in higher production costs from higher cleaning costs as well as from reduced or halted production.

The above-mentioned shortcomings also exist with respect to the spray cleaning device depicted in FIG. 3. For example, when attempting to clean the outer exterior wall of buildings, roads or various installations on streets and tunnels, spray cleaning devices depicted in FIG. 3 produce leakage of waste products and cleaning mixtures. This causes environmental problems and disrupts traffic. As a result, traffic is often restricted or cleaning must be scheduled to avoid hours during which there is significant traffic.

In addition, when prior art devices are used to clean the human body and/or the biological waste of people whose free movement is restricted, i.e. elderly, physically disabled etc., their guardian or caretaker must be present to perform these procedures. FIGS. 4 and 5 illustrate devices that assist the elderly and disabled in performing the above-mentioned tasks. However, these devices are mostly installed in special buildings or hospitals and their numbers are very limited. Furthermore, even when these devices are available, the user must make numerous movements with great effort over a painful length of time thereby necessitating the assistance of others to use the devices. During a cleaning procedure, for example, someone has to assist in washing with a water towel, then lifting and moving the body to the tub to complete the wash. In addition, with respect to assistance in removing and cleaning human waste, it requires much sacrifice and/or love to assist the elderly and physically disabled in thee tasks. Nowadays, finding those with the requisite sacrifice is even harder. Between the efforts of the user and the efforts of the one assisting, much patience, sacrifice, service and love is needed to overcome the difficulties. The individuals themselves, though they may want to, are unable to perform these tasks alone. Without the proper help these individuals are left in unhealthy condition.

SUMMARY OF THE PRESENT INVENTION

What has been needed for a long time is a comprehensive cleaning device that performs all the above functions and performs them effectively and efficiently. One of the objects of the present invention is to provide a cleaning device that combines all the capabilities needed in a cleaning apparatus.

Another object of the present invention is to overcome the disadvantages of the prior art and meet this additional important need for a device that can allow an elderly or disabled person to perform human cleaning functions. It does this by combining the spraying and in-take functions in one device, thus eliminating dripping or flowing of liquid during cleaning and solving the problem that some locations are "impossible" places to clean.

Another object is to prevent environmental pollution by not distributing or creating dust when cleaning.

Still another object is to reduce and prevent waste of labor by shortening the cleaning time. There is less mess because the water does not leak during wall or ceiling cleaning. Removal of fixtures is unnecessary.

Yet another object is to clean the floors and walls of factories without stopping the production line since there is no leak or mess.

Another object is to clean without the need for cleaning experts to be present.

A further object of the present invention is to clean the outer walls of buildings, roads and road facilities with no waste water produced and discharged to the street causing traffic blockage or congestion.

A further object of the present invention is to clean areas that hitherto have been considered impossible to clean, thereby enhancing the quality and quantity of goods produced by improving the cleanliness of the work environment.

Another object is to clean the bottom of rivers, thereby eliminating polluted water. In the future, the invention may be useful in cleaning the ocean floor.

Another object is to eliminate gas and fumes created by chemicals by the intake of smell, fumes and dust as well as heat created from industrial operation. By doing so, it can prevent pollution and save energy used by air conditioners and other air purifying devices inside the factory.

The most important object of the present invention is to clean the human body and to dispose of waste during and after waste discharge by elderly people, medical patients and the physically disabled even when lying in bed. The invention will thereby contribute to the physical, psychological and social recuperation of many individuals in need.

This invention cleans the human body and disposes of human waste by children, elderly and the physically disabled and by patients lying in bed. It cleans and disinfects wounds, cuts, eyes, ears, etc. It washes dirt and human waste from the body. It performs hot and cold wash treatment and massage.

With respect to objects, this invention cleans and disinfects floors, walls, ceilings and windows, performs carpet cleaning, car washing (inside and out) watering the lawn, factory dust cleaning, fume intake, the cleaning of heavy machinery, the interior and exterior of buildings, roads, runways, tunnels, road equipment, deep tanks and receptacles, animal disinfection, product equipment cleaning and cleaning other difficult to clean areas and products.

In addition, this invention can be useful in households, hospitals, elderly homes, health resorts, sanitariums, orphanages, sanitation businesses, food and hygienic businesses, the meat, agriculture, livestock and seafood industries, automobile factories, auto body shops, the machine industry, construction, carpentry, chemical and oil industries, the shipbuilding industry, the cast iron industry, paper manufacturing, textile factories, electronic factories, office areas, hotels and other work places that are difficult to clean, disinfect and sterilize.

In order to clean, the device of the present invention sprays water or a mixture of water and cleaning liquid while simultaneously sucking in waste product and any remaining water. The device also temporarily stores and discharges the waste gathered by the intake portion of the device. Most significantly, it performs the function of spraying water and the suction function simultaneously. As described in more detail below, this is accomplished by attaching an additional pressure hose to a designated blow-out device which pumps either water or a water and cleaning liquid mixture to be used for spraying.

DETAILED DESCRIPTION OF THE DRAWINGS

Figure 1A:
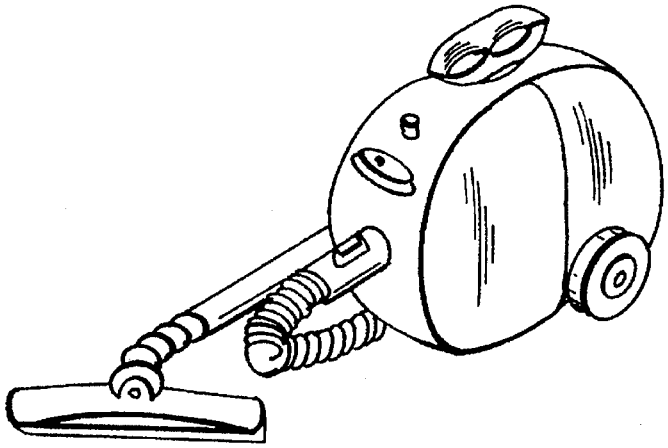
FIG. 1A PRIOR ART
FIG. 1A is a perspective view of a prior art vacuum cleaning device.
Figure 1B:
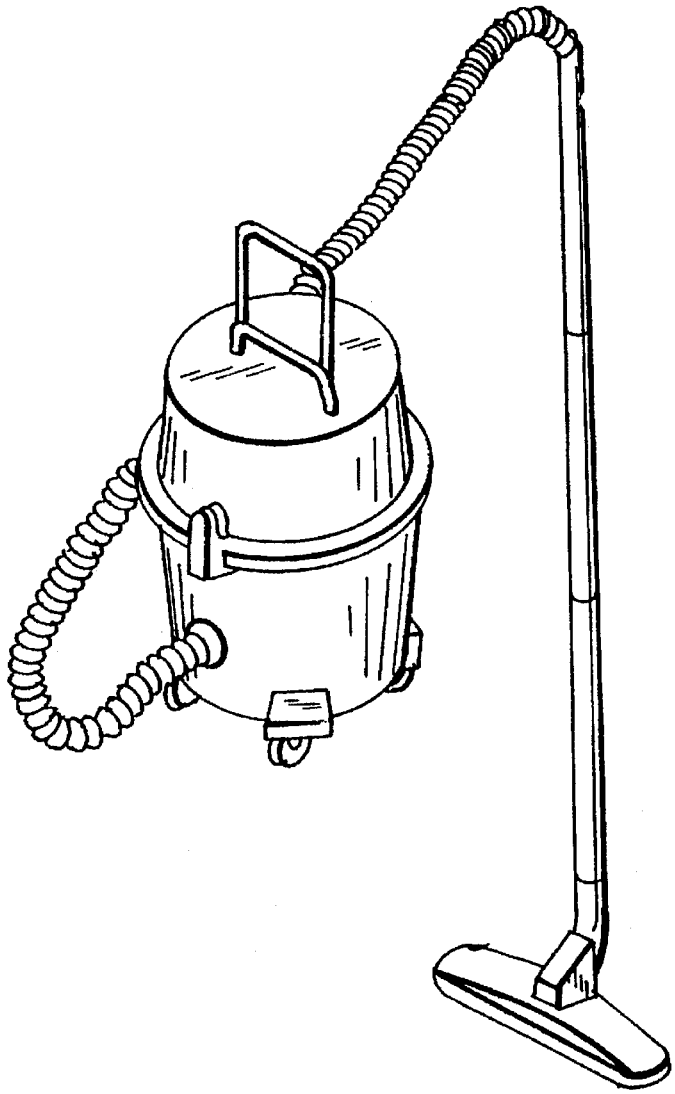
FIG. 1B PRIOR ART
FIG. 1B is a perspective view of prior art vacuum cleaning devices.
Figure 2:
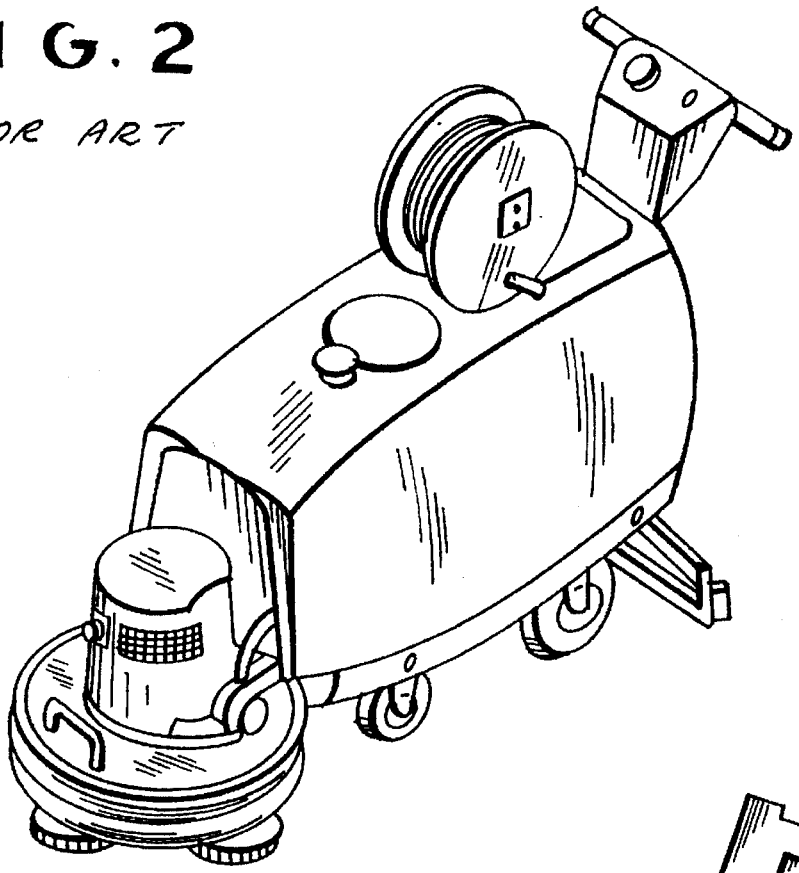
FIG. 2 PRIOR ART
FIG. 2 is a perspective view of a prior art brushing cleaning device.
Figure 3:
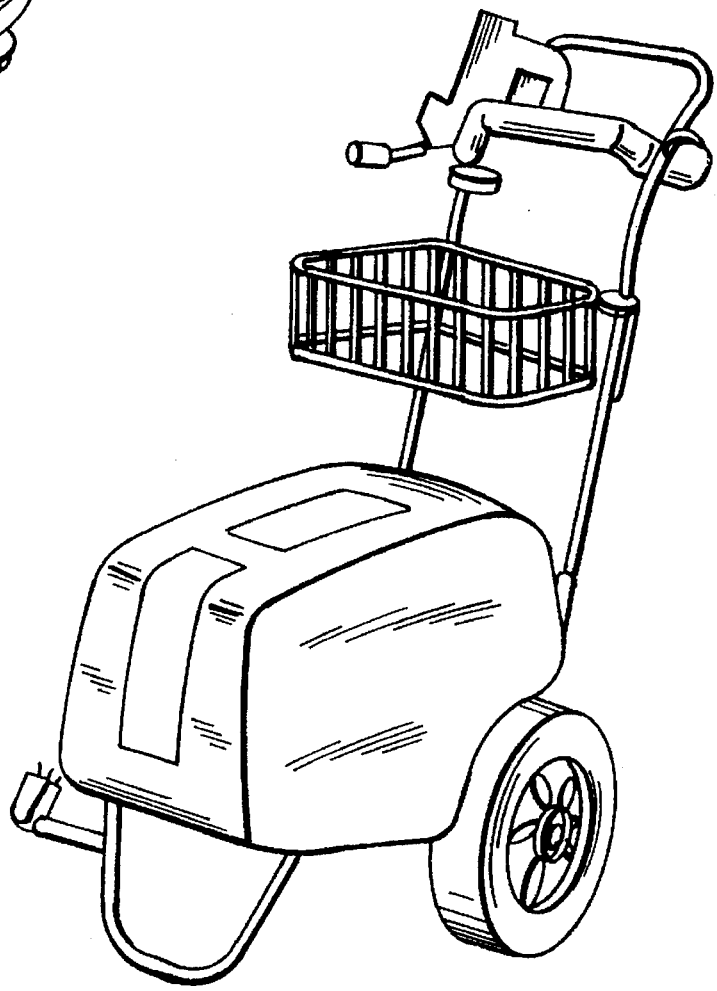
FIG. 3 PRIOR ART
FIG. 3 is a perspective view of a prior art jet spray cleaning device.
Figure 4A:
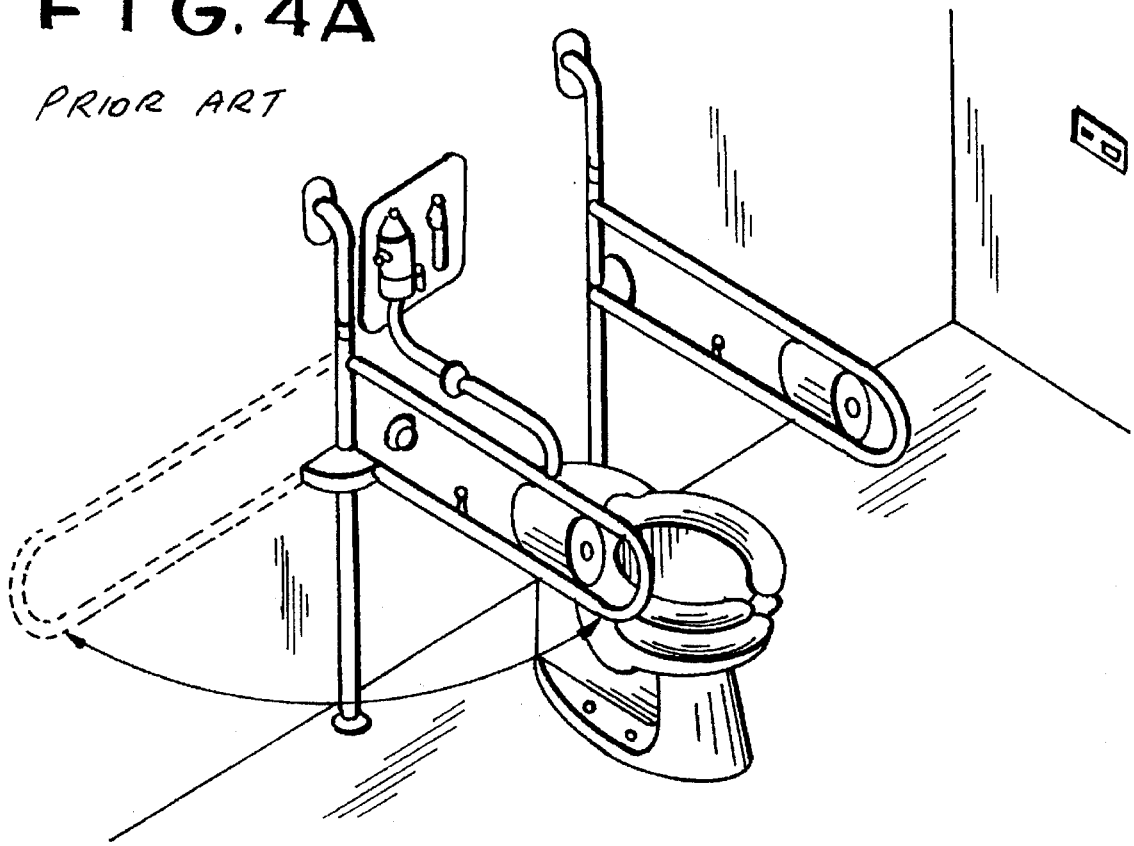
FIG. 4A PRIOR ART
FIGS. 4A and 4B are perspective views of prior art devices for disposing of human body waste used by individuals having restricted freedom of movement.
Figure 4B:
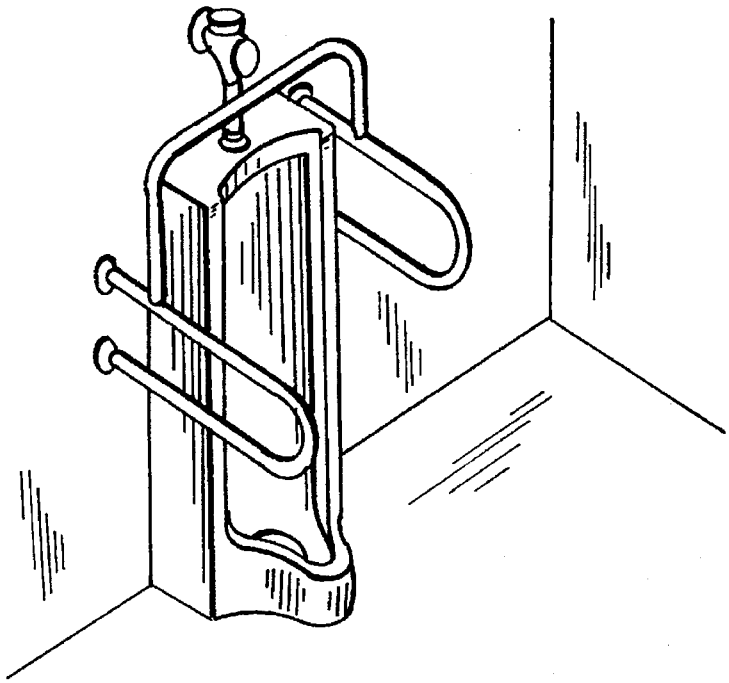
FIG. 4B PRIOR ART
Figure 5A:
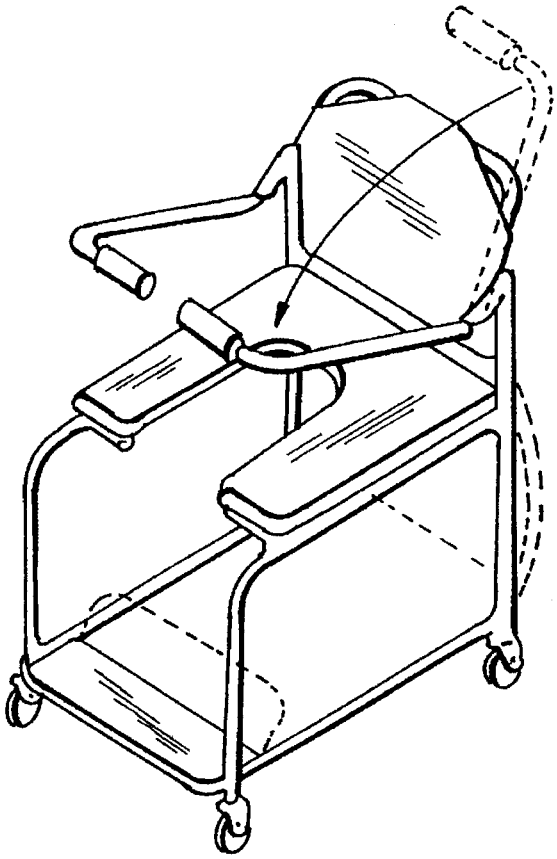
FIG. 5A PRIOR ART
FIGS. 5A and 5B are perspective views of prior art devices used by individuals having restricted freedom of movement in cleaning the human body.
Figure 5B:
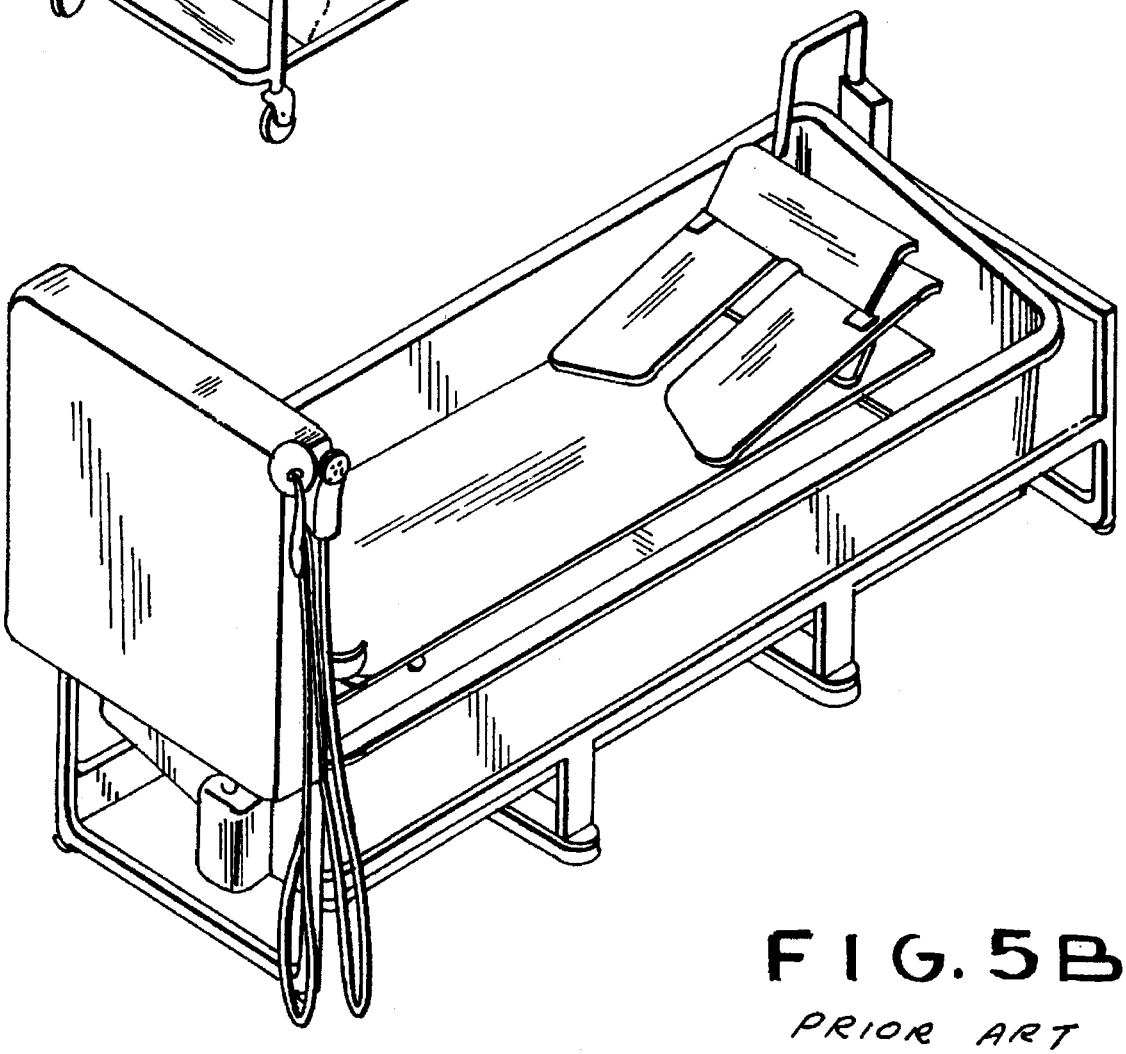
FIG. 5B PRIOR ART
Figure 6A:
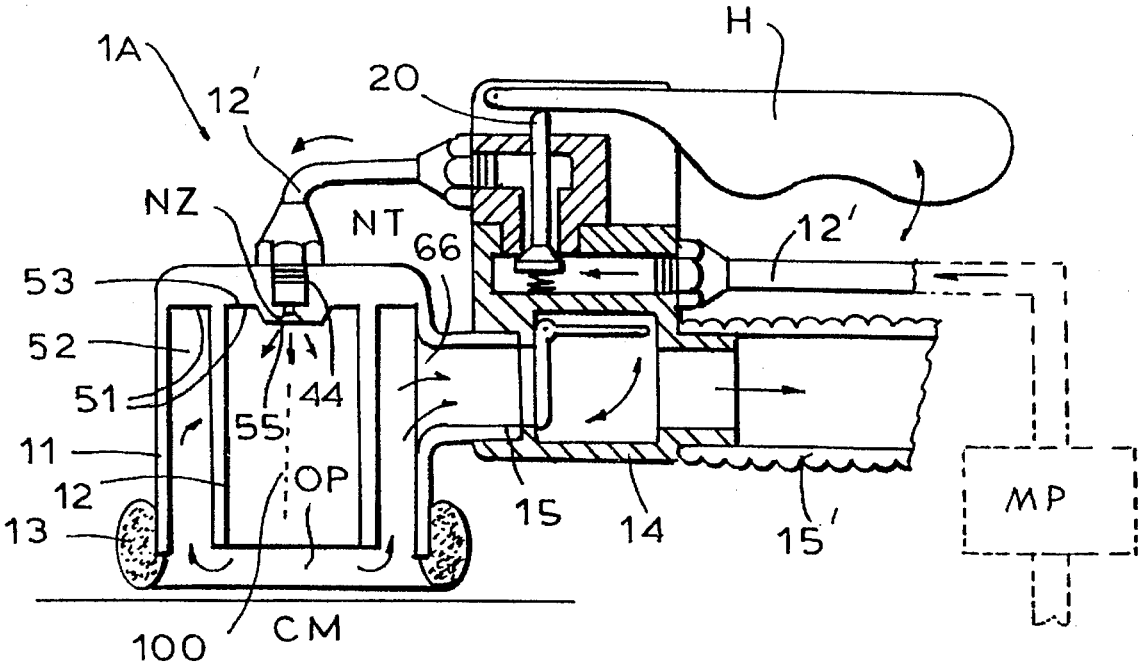
FIG. 6A is a partial cross-sectional diagram of a closed configuration of the cleaning portion of the device represented by the present invention.

Referring to FIG. 6A, there is depicted a closed type configuration of the in-take and blow-out device 1A (also referred to sometimes as the blow out and in take device) which has the top part 51 closed. The left portion of the device 1A depicted in FIG. 6A consists mainly of two tubes inside one another, one having a large diameter 52 and one having a smaller diameter 53. The inner tube (smaller diameter tube) forms a blow out space and the outer tube (larger diameter) forms an in take device. The bottom section of the tubes are open at opening OP. The top section of these two tubes is closed off, in order to be aligned at one vertical center line 100. An in-take space is thus created between the two tubes and a blow-out space is created inside the tube of smaller diameter 53. An in-take device 11 is thus formed from the outer tube 52 and a blow-out device 12 is thus formed from the inner or smaller diameter tube 53.

At the center of the top of the inner or smaller diameter tube 53 is an opening 55. A high pressure hose 12' extends downward onto the top of the opening 55. The end of the hose 12' has a check valve 44 extending over the hole 55. The other end of the check valve 44 is connected to a nut NT. The inner part of the opening 55 leads into and creates the blow-out device 12 through which the attached spray nozzle NZ of high pressure hose 12' sprays. The end of the pressure hose 12' has another nut and leads to a check valve connecting path 14.

The lower portion of the in-take device 11 has pad 13 attached. An opening 66 is placed on one side of the in-take device 11 creating the waste in-take path 15. The waste in-take path 15 is forced in to be connected to a flexible hose 15' at a gradually diminishing opening point (taper hole) between the check-valve connecting path 14 and the flexible hose 15'.

As illustrated in FIG. 6A, CM represents the object to be cleaned. H is a handle that pushes down on push-valve 20 which connects to the high pressure hose 12'. The arrows depict the direction of liquids through the high pressure hose 12', through the opening 55 at the top of the smaller diameter tube 53 and into the larger diameter tube 52.

Figure 6B:
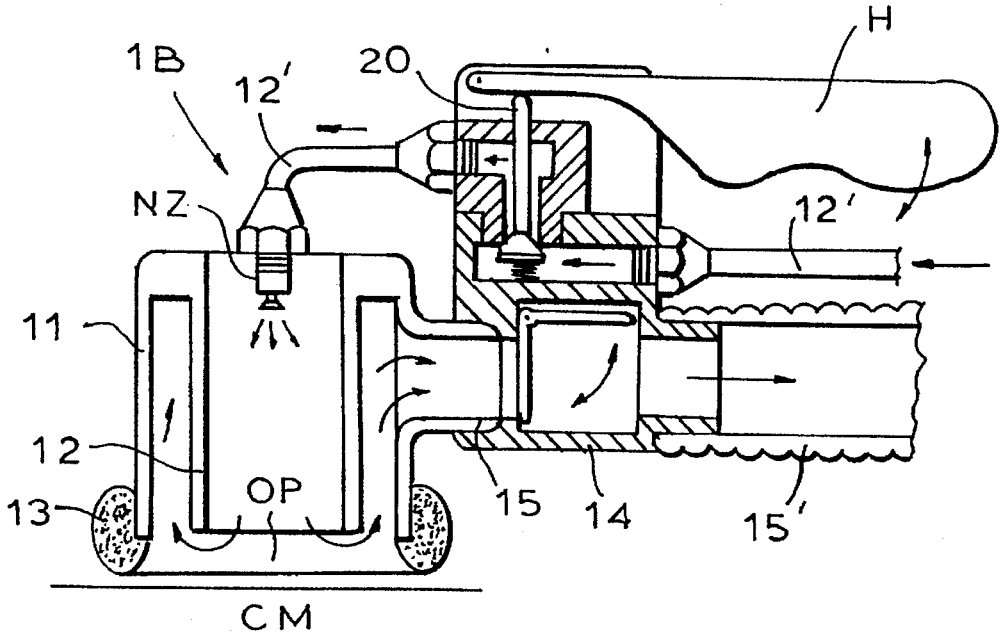
FIG. 6B is a partial cross-sectional diagram of an open configuration of the cleaning portion of the device represented by the present invention.

The blow out and in take device 1B depicted in FIG. 6B is identical to that of FIG. 6A except that the intake space between the in-take device 11 and the blow-out device 12 is closed on top and except that the inside top part of the blow-out space of the blow-out device 12 is open. Accordingly, the in-take device 11, the blow-out device 12, the pad 13, the check valve connecting path 14, the waste in-take path 15 and the opening part OP are identical to the device depicted in FIG. 6A. Since the top part of the blow-out device 12 is open, various objects can be attached there depending on the use. For example, either a brush used in traditional brush cleaners can be attached or else angle grinder soldering iron, drills for a production machine or other types of nozzles can be attached.

Figure 6C:
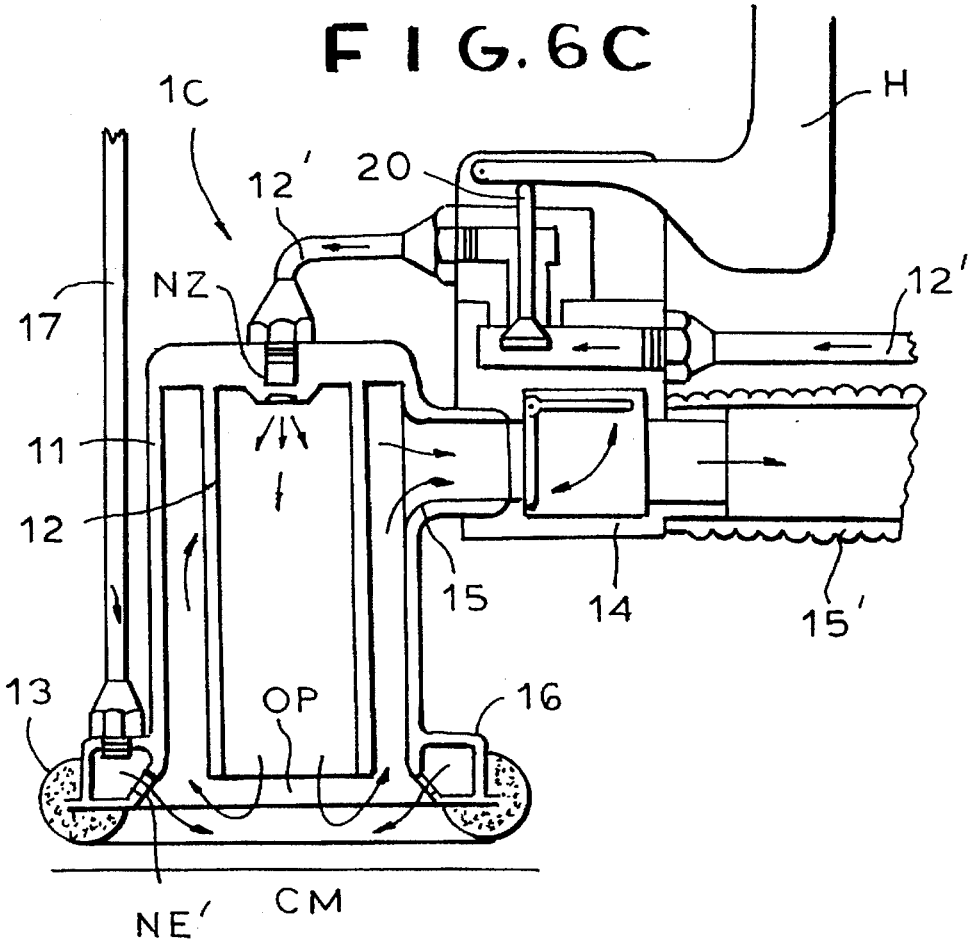
FIG. 6C is a partial cross-sectional diagram of a submersion configuration of the cleaning portion of the device represented by the present invention.

The submersion type cleaning portion 1C depicted in FIG. 6C is used mostly for cleaning the bottom of swimming pools, large water tanks or reservoirs and is similar to the closed device of FIG. 6A except that since it has to be submerged in water to clean waste from the bottom it has certain additional attachments. In particular it has an air tube 17 through which air from outside the water travels to perform the in-take function. In addition, attached to the air tube is an air chamber 16 installed at the lower part of the in-take device 11. Nozzle NZ' is an air nozzle at the bottom of the air tube 17.

Figure 6D:
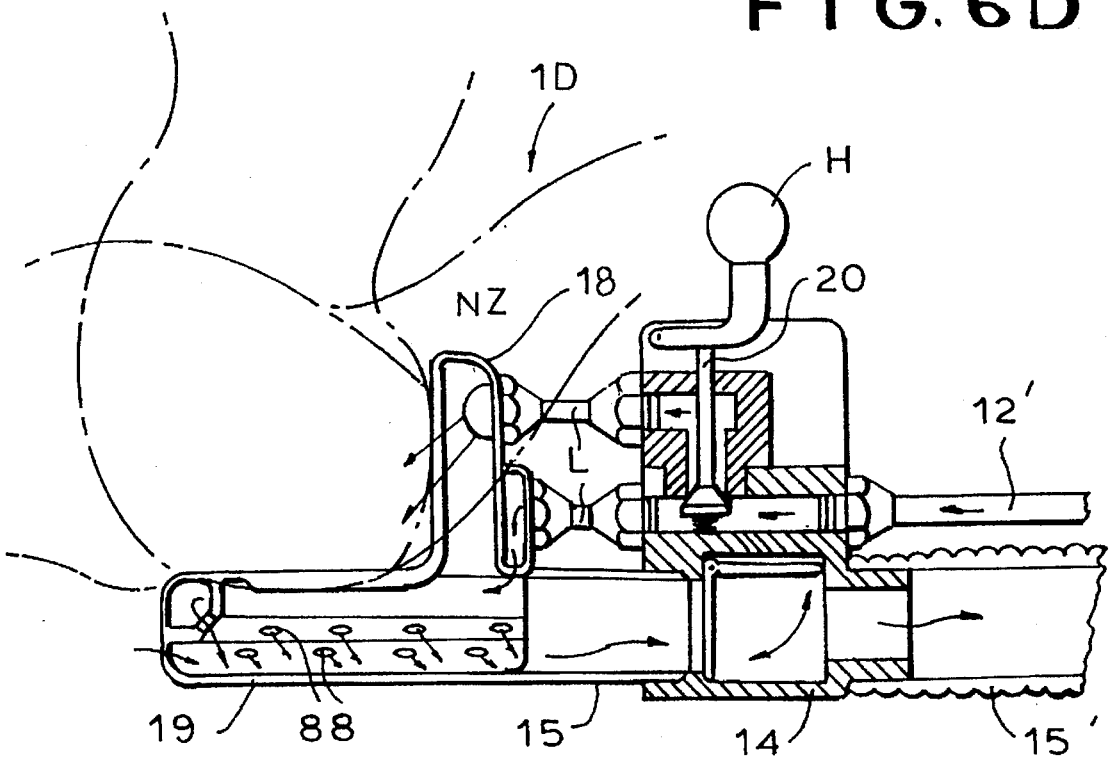
FIG. 6D is a partial cross-sectional diagram of a lavatory configuration of the cleaning portion of the device represented by the present invention.

The lavatory type in take and blow out device 1D depicted in FIG. 6D is for elderly individuals, medical patients and disabled individuals for toilet purposes and/or for cleaning the anal and buttocks area during and after human waste discharge. When the person sits on the toilet seat area 19*a* (sometimes called "toilet seat") of toilet seat portion 19 of device 1D, device 1D is between his or her legs. In order to prevent urine from spilling or leaking, projecting part 18 is installed. Projecting part 18 can also be used to rest a newspaper on since when the person using the lavatory device 1D sits on toilet seat 19 he or she is facing projecting part 18. The part of device 1D that meets the buttocks of the seated individual is shaped as the conventional toilet seat 19*a* having an open area 19*b* at its center. Because of the cushion-like nature of a human buttocks, part of it will descend into the interior of open area 19*b* of toilet seat 19*a* and of toilet seat portion 19.

When an individual wishes to use the lavatory type device 1D, the person sits on the toilet seat 19*a* and the person's buttocks area thereby covers the open area 19*b* in the center of the toilet seat 19*a*. This creates a suction effect on the portion of the anus and buttocks that makes contact with toilet seat 19*a* and on the part of the buttocks that projects downwardly into the open area 19*b* at the center of the toilet seat 19*a* and of toilet seat portion 19.

As seen from FIG. 6D and from the top view of the lavatory device depicted in FIG. 6E, the part which touches the buttocks area has a water pressure head 80, a tube-like water distributing area going around the inside of the seat. The water pressure head 80 is connected to projecting part 18 in front of the toilet seat 19*a* of toilet seat portion 19. Pressure hose 12', when connected to a turned on water faucet or to a turned on high pressure blow-out motor pump MP (depicted in FIG. 7), receives and shoots water rapidly through the lower of two connecting tubes L and the water then circulates through water pressure head 80. Water circulating forcefully through water pressure head 80 is sprayed out of the water pressure head 80 in a forceful spraying action through water openings 77 located at various points along the lower inside portion of water pressure head 80 and this water is sprayed through the openings 77 towards the bottom of the toilet seat portion 19.

As the water shoots it breaks the human waste that has dropped from the buttocks area and pushes it towards the waste in-take path 15 of FIG. 6D, thus preventing it from settling at the bottom of toilet seat portion 19. This speeds the waste in-take process and makes the user feel comfortable with the low bottom configuration. The water that is sprayed can be controlled by turning on a switch which sprays the right amount of water while performing the in-take of waste. When the user is finished, the handle H attached to the check-valve connecting path 14 can be pressed or pushed. The effect of pressing or pushing handle H is to clear the passageway leading from 20B to 20C to the upper L tube and thereby allow water from water pressure hose 12' which is already shooting through the lower of two connecting tubes L (and into water pressure head 80) to also shoot through the upper of two connecting tubes L through nozzle NZ. One way this may be accomplished is that when the handle H is pressed or pushed, the handle H, which is connected to a pin, will in a turning motion push down and open push valve 20 which had been closed thereby letting the water through the upper of two connecting tubes L. The water sprays out from the nozzle NZ attached to the inside of the projecting part 18 and thereby cleans the genital and other areas of the person's body since the person, when using the lavatory device, is facing projecting part 18.

When using the lavatory device of FIG. 6D, in order to prevent the user's buttocks from sticking to the toilet seat 19*a* from the suction effect created by the device while seated, there are air holes 88 emanating from the outer wall of the device below the water pressure head 80. As seen by the arrow 88*a* showing the air flow through air holes 88 in FIG. 6D, the air holes 88 are generally at a 45 degree angle to the bottom floor of the device 1D (and to the side wall of the device 1D through they emanate) and point the air in the direction of the user's buttocks and to the bottom of the toilet seat portion 19 where it can dry the water from the buttocks area and at the same time create and maintain the air needed to perform the in-take function described in relation to FIG. 7. As seen in FIG. 6D, the upper series of openings 77 below the toilet seat 19*a* in FIG. 6D are water holes and are depicted at a level corresponding to the level of the lower portion of water pressure head 80 whereas the lower tier of openings 88 represent air holes.

This lavatory device makes it easy to dispose of human waste of any type in different situations. For unconscious medical patients, it can be shaped in the form of a disposable diaper and attached to the buttocks with an on-off sensor installed under the toilet seat portion 19 to make it possible for it to work automatically without the assistance of a third party. It can also be installed on a vehicle for long distance traveling. It can also enhance the care of elderly and physically disabled individuals.

Figure 7:
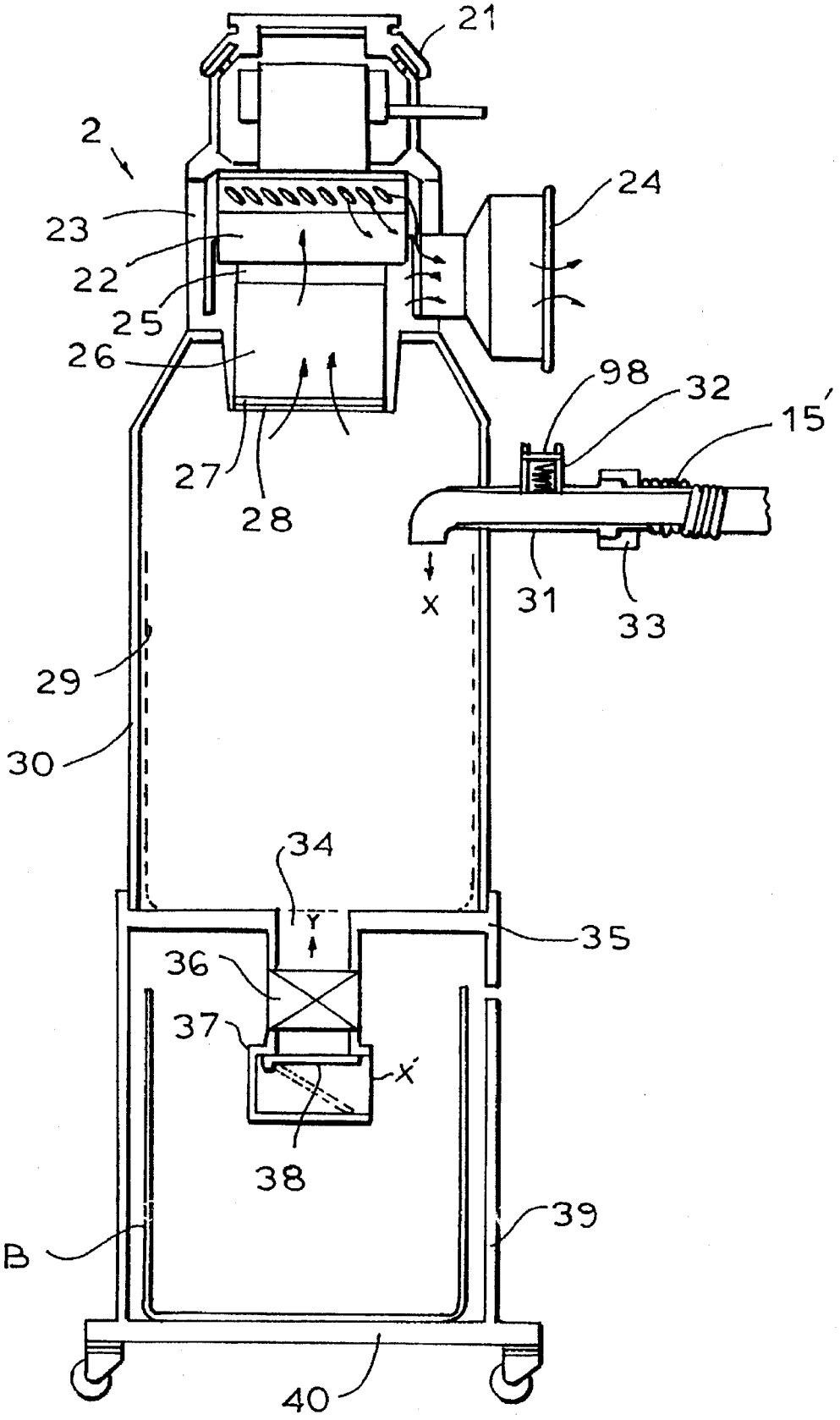
FIG. 7 is a partial cross-sectional diagram of the in-take and waste disposal portion of the device represented by the present invention.

FIG. 7 is a partial cross-sectional diagram of the present invention's in-take and waste disposal device 2. This in-take and waste disposal device 2 attaches to a motor pump housing 23 which contains the discharge motor pump 22 and which has motor cover 21. Noise and exhaust port 24 is attached to one part of the motor pump housing 23. A filter chamber 28 is attached to the lower part of the motor pump housing 23. The filter chamber 28 contains, from bottom to top respectively, a first filter 27, a carbon filter 26 and a second filter 25 at different levels. In-take discharge waste receipt tank 30 which contains receiving filter 29 is connected under the filter chamber 28. An L-shaped intake tube 31 is attached at the top of one side of the in-take discharge waste receipt tank through a circular opening. On one side of the L-shaped tube 31 a pressure control device 32 is attached. A flexible hose 15' is attached to the L-shaped tube 31 through a connecting tube 33.

The lower part of the tank 30 is connected to the top part of a frame 35. Waste discharge path 34, which is smaller in size than tank 30 is connected to the top center of the frame 35. Valve 36 is connected to the lower part of the waste discharge path 34. Below the valve 36, a sill 37 is attached to the outer part of waste discharge path 34 and the sill 37 has inside it a pin that holds the circular disk-shaped shutter 38. Discharge path X' is opened to discharge waste to the waste holding tank B or to a sewer if connected to a sewer (or other discharge area). The bottom of the frame 35 has wheels or a mobile device 40 attached so that the equipment can easily be moved about. Finally, receipt tank connecting path 39 is attached to one part of the frame 35.

OPERATION OF THE INVENTION

In order to clean using the above-mentioned cleaning apparatus, one must first choose the type of blow-out and in-take device 1 to be used depending on the nature of the object to be cleaned. For example, if the waste is of a household nature, or the floor or ceiling of a building, device depicted in FIG. 6A is generally chosen. For roads, roadside equipment and other objects needing brush cleaning, the open configuration device of FIG. 6B is chosen. For large water tanks, swimming pools, and the bottom of reservoirs, the submersion type, FIG. 6C is chosen. Lastly, to clean the body, particularly the anal and buttocks area of elderly individuals, medical patients and physically disabled during and after waste discharge, the lavatory type of FIG. 6D is chosen.

Referring generally to FIGS. 6A, 6B, 6C, 6D and 7, once the appropriate cleaning portion 1 is chosen, the flexible hose 15' (which is connected to the check valve 14 which in turn is next to waste in-take path 15 as depicted in FIGS. 6A, 6B, 6C and 6D) needs to be connected to the connecting tube 33 as depicted in FIG. 7. The high pressure hose 12' (FIGS. 6A–6D) should then be connected to a water faucet or high pressure blow-out motor pump MP and one turns on the "ON" switch thereon (not shown). Place the pad 13 (FIGS. 6A–6C) next to the object needed to be cleaned or place the blow-out and in-take lavatory device 1D depicted in FIG. 6D between the legs and place it on the buttocks as shown in FIG. 6D.

By turning on the "ON" switch (not shown), the high pressure blow-out motor pump MP shown as the dotted line in FIG. 6A as well as the discharge motor pump 22 (FIG. 7) begin to operate. With the operation of the high pressure blow out motor pump MP, a mixture of water and cleaning fluid moves through the high pressure hose 12' to the push valve 20 of the check valve connecting path 14 to await spraying. At this point, the pad 13 is in contact with the surface of the object to be cleaned, much as a floor is wiped with a mop. When handle H (FIGS. 6A–6D) is pressed with a consistent force, push valve 20 of the check valve connecting path 14 is opened leading the cleaning mixture through the spray nozzle NZ and then to the object to be cleaned CM.

At this point, in case the tap water is used, connect the high pressure hose 12' to the water faucet and stop the high pressure blow-out motor pump MP using the On/Off switch.

As the above high pressure blow-out pump operates, discharge motor pump 22 of waste device 2 also operates. Therefore, through the operation of discharge motor pump 22, the air in the in-take discharge waste receipt tank 30 moves through the first filter 27 and carbon filter 26, and then through the second filter 25, and leaves through the noise and exhaust port 24. This creates a vacuum within the tank 30. When this occurs, the L-shaped intake tube 31 directs the suction power toward the direction of the "X" arrow sign (FIG. 7). In waste discharge path 34, a suction power created leads toward the "Y" arrow sign direction. By this suction power, the circular disk-shaped shutter 38 is pulled up to close the waste discharge path 34. The mixed water and waste caused by cleaning is then taken in through cleaning portion 1 (FIGS. 6A–D) and moves through waste in-take path 15 and the L-shaped intake tube 31, eventually settling in the intake discharge waste receipt tank 30.

Once the settled waste reaches a certain level of height, it is discharged through the waste discharge path 34. While the waste is being discharged the above-mentioned in-take suction power still exists. This is due to the following:

The diameter and the cross-section of waste discharge path 34 is smaller than that of intake discharge waste receipt tank 30. Consequently, when discharge motor pump 22 intakes the air inside the tank 30, a vacuum arises letting the waste and water to move in through the L-shaped intake tube 31 leading to the tank 30 and into the waste discharge path 34. This makes the suction power greater at the intake discharge waste receipt tank 30 which has a larger cross-section than the waste discharge path 34 in accordance with the theory of Pascal. [Pressure equals the force per unit area and a pressure change in one part of a fluid is transmitted to every portion of the fluid and to the walls of the container.] This suction causes the circular disk-shaped shutter 38, which gets sucked up, to close the waste discharge path 34. Therefore, the waste, including water, does not get discharged or leak from the intake discharge waste receipt tank 30.

According to Torricelli's theory, when the tank 30 is filled up with waste, it builds up pressure due to the fluid's height. Pressure increases as the waste fluid fills the tank 30 and its force exceeds the upward force applied to the circular disk-shaped shutter 38 which was sucked up due to the pressure differential as explained above. [The greater the height of the liquid flowing out of an opening in a tank, the greater the pressure on the fluid to flow out the opening.] When the pressure from the accumulating height of waste fluid increase to the point where it begins to exceed the pressure on the disk-shaped shutter 38 from the upward sucking force of waste moving in the direction of the tank 30, the circular disk-shaped shutter 38 pushes open the waste discharge path 34. This releases the waste gathered at the intake tank 30 through the waste discharge path 34. This waste can be collected in cleaning tank B or can be discharged to the sewer or other designated area through a hose connected to the lower area of waste discharge path 34.

Once the waste is discharged the height of the fluid has decreased so, once again, according to Torricelli's theory, the above-mentioned suction increases to a point greater than the force pushing the circular disk-shaped shutter 38 causing the board 38 to close the waste discharge path 34. While waste is entering the tank 30 through the L-shaped intake tube 31, waste automatically is discharged through the waste discharge path 34. Because of this action, intake discharge waste receipt tank 30 constantly maintains a level of retrieved waste within a specified range of height. Consequently, unlike existing vacuum cleaners, this invention can discharge waste without increasing the waste intake tank or stopping the cleaning operation.

Finally, the pressure control device 32 of FIG. 7 is to adjust the pressure within the blow-out and in-take devices depicted in FIGS. 6A–6D caused during the suction. Valve 36 is to turn on and off the operation of the circular disk-shaped shutter 38.

CLEANING PROCEDURE

The cleaning apparatus operating as mentioned above can use various types of pads 13 depending on the type of object to be cleaned. To clean the floor of large buildings, or the bottom of pools and reservoirs, a brush type pad 13 is recommended. For cleaning of the human body, a bathing pad which is made of pad 13 wrapped on the outside with a bathing towel is recommended.

The cleaning method using the invention disclosed herein is performed as follows. Rub the object to be cleaned by placing the pad 13 tightly to the surface. The object is cleaned as the pad 13 acts as a mop. At the same time, cleaning fluid and water is sprayed on the waste to be cleaned. Also at the same time the derivative of the cleaning fluid and the waste is retrieved at the intake tank 30 through the flexible hose 15'. The waste is discharged through waste discharge path 34. This type of cleaning should use the right size of pad 13 and cleaning portion 1A–1D. The size and power of the motor should also be considered. The proper horsepower for the motor should be selected, depending on the type and nature of the waste to be cleaned. For example, to clean the floor of the buildings, the pad 13, the cleaning portion 1A–1D and the waste discharge device 2 should use a larger powerful motor. In contrast, for household cleaning or for body cleaning purposes, a smaller pad 13 and cleaning portion 1A–1D should be used, and a less powerful motor should be used for waste discharge device 2. For body cleaning purposes, the smaller pad 13 should be used directly to the skin for rubbing.

For general cleaning, body cleaning and for cleaning of the anus and the buttocks area during and after human waste discharge, pressure control device 32 is used to control the pressure in the flexible hose 15' depending on the nature and the type of cleaning to be performed. This controls the suction power of the apparatus. The configuration of the pressure control device 32 is comprised of a circular valve plate 98, an opening and a coiled spring supporting the bottom to plug the opening.

On the other hand, to clean the anus and the surrounding buttocks area during and after the human waste discharge, the lavatory device 1D depicted in FIG. 6D is used. In this case, use one hand to hold the handle H and place the cleaning portion 1D between the legs and then sit on the toilet seat 19. After discharging human waste, press the handle H which in turn pushes down the push valve 20 setting into motion the simultaneous spraying and intake cleaning action. The direction of the nozzle NZ is designed to be adjusted to either the top, bottom, left or right.

OTHER USES

The invention described herein can also be used to fumigate and to sterilize. It can also be used to clean manufacturing machines. Depending on the need,either the blow-out or in-take functions can be suspended and put to use for different purposes. Additionally, the in-take and waste disposal device of this invention can be installed in permanent position at a hospital with a hose or intake device attached to be used in individual rooms. In addition, a lead-welding device can be attached in place of a spraying nozzle.

It is to be understood that the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described.

What is claimed is:

1. A comprehensive nonleaking cleaning apparatus for cleaning humans comprising:

a cleaning portion that sprays water and cleaning fluid while receiving waste products of the sprayed fluid;

a waste discharge device that temporarily stores and discharges waste collected from said blow out and in take device; and a high pressure hose that is attached to said blow out and in take device for spraying fluid therein and that is attached to a blow out motor pump, wherein a toilet seat portion forming part of said cleaning portion, for a human to sit thereon and discharge waste therein, receives water and cleaning fluid sprayed from a hose of the cleaning portion onto the human to clean the human, and whereby said toilet seat portion receives water and cleaning fluid that circulates under a toilet seat of said toilet seat portion, cleans the human's buttocks and anus, smashes into and thereby breaks the bodily waste discharged by the human and transmits the bodily waste to a waste intake path that connects to said waste discharge device.

2. A comprehensive nonleaking cleaning apparatus for cleaning humans comprising:

a cleaning portion that sprays water and cleaning fluid while receiving waste products of the sprayed fluid;

a waste discharge device that temporarily stores and discharges waste collected from said blow out and in take device; and a high pressure hose that is attached to said blow out and in take device for spraying fluid therein and that is attached to a blow out motor pump, wherein a toilet seat portion forming part of said cleaning portion has a toilet seat for a human to sit on and cover an open area in said toilet seat and for the human to discharge waste into said toilet seat portion, said toilet seat portion receiving water and cleaning fluid sprayed from a hose of the cleaning portion onto the human to clean the human, said toilet seat portion also receiving rapidly moving water and cleaning fluid that circulates in a water pressure head under the toilet seat and is sprayed out of the water pressure head to clean the human's buttocks and anus, to smash into and thereby break the bodily waste discharged by the human and to transmit the bodily waste to a waste intake path that connects to said waste discharge device.

3. The apparatus of claim 2, wherein air holes are provided in an outer wall of said toilet seat portion to suck in air that dries the human's buttocks and anus and prevents the buttocks from sticking to the toilet seat.

* * * * *